United States Patent [19]

Egli

[11] 4,275,775

[45] Jun. 30, 1981

[54] SYSTEM FOR THE ACCURATE DOSING OF BULK MATERIAL

[75] Inventor: Alwin Egli, Beringen, Switzerland

[73] Assignee: SIG Schweizerische Industrie-Gesellschaft, Neuhausen am Rheinfall, Switzerland

[21] Appl. No.: 34,533

[22] Filed: Apr. 30, 1979

[30] Foreign Application Priority Data

May 12, 1978 [CH] Switzerland ..... 5240/78

[51] Int. Cl.[3] ..... B65B 1/32

[52] U.S. Cl. ..... 141/83; 141/103; 177/53; 177/81; 222/55; 222/77; 222/338

[58] Field of Search ..... 222/55, 63, 77, 311, 222/312, 336, 337, 338, 360, 367, 516; 141/83, 103, 128; 177/53, 80, 81, 122, 123, 56

[56] References Cited

U.S. PATENT DOCUMENTS

| | | | |
|---|---|---|---|
| 1,947,210 | 2/1934 | McCrery | 222/338 X |
| 2,766,911 | 10/1956 | Greaves et al. | 222/337 X |
| 3,073,398 | 1/1963 | Blodgett et al. | 177/53 |
| 3,209,844 | 10/1965 | Stambera et al. | 177/81 X |
| 3,703,902 | 11/1972 | Sargrove | 177/123 X |
| 3,985,266 | 10/1976 | Wright, Jr. | 222/55 X |

FOREIGN PATENT DOCUMENTS

| | | | |
|---|---|---|---|
| 2600262 | 7/1976 | Fed. Rep. of Germany . | |
| 632626 | 11/1949 | United Kingdom | 177/123 |

*Primary Examiner*—Robert J. Spar
*Assistant Examiner*—Edward M. Wacyra
*Attorney, Agent, or Firm*—Spencer & Kaye

[57] ABSTRACT

A dosing system for filling a receptacle with a predetermined desired weight of flowable bulk material. The system has a main dosing apparatus for charging the receptable to an extent less than the predetermined weight and an additional dosing apparatus for complementally charging each receptacle to an extent equal to the deviation between the desired weight and the actual weight resulting from the charging by the main dosing apparatus. The additional dosing apparatus has a dispensing wheel having a plurality of cells of predetermined volume. There is further provided a movably supported shroud member having a shroud face extending along a circumferential portion of the wheel and separating an inlet chamber from an outlet chamber. The position of the shroud member is adjustable for determining a minimum clearance between the shroud face and the periphery of the wheel. A spring urges the shroud member towards the wheel for allowing a resilient yielding movement of the shroud member away from the wheel. A stepping motor is coupled to the wheel for rotating the same to discharge the bulk material. A scale determines the above-defined actual weight of the receptacle. A motor-actuating arrangement causes rotation of the wheel through as many cell divisions as necessary to charge the receptacle up to the desired weight value.

10 Claims, 6 Drawing Figures

SYSTEM FOR THE ACCURATE DOSING OF BULK MATERIAL

BACKGROUND OF THE INVENTION

This invention relates to an automatically operating system for dispensing a bulk material, such as granulated sugar of predetermined weight in consecutively advanced receptacles.

Dosing apparatuses of conventional structure are disadvantageous in that they do not operate with a sufficient accuracy to ensure that each receptacle is filled to the predetermined weight between very narrow tolerances. In conventional filling apparatuses, in order to ensure an error of ±1% for preparing, for example, packages containing 1000 g of sugar, the setting for the desired weight should be 1010 g. This results in a significant financial loss since conceivably some of the packages will contain 1020 g. It has been known for long to first fill the packages slightly under the desired weight and, after determining the actual weight, to then complement the package by the amount of the deviation. An apparatus which automatically performs such a complemental dosing is, however, not known. The reason therefor may lie in the difficulty to meet conditions that are required to make such a device economical. Such a device has to be rapid, extremely accurate and above all, it has to operate reliably.

SUMMARY OF THE INVENTION

It is an object of the invention to provide an automatically operating dosage-complementing dispensing apparatus which operates rapidly, reliably and with a high accuracy.

This object and others to become apparent as the specification progresses, are accomplished by the invention, according to which, briefly stated, the dosing system for filling a receptacle with a predetermined desired weight of flowable bulk material, has a main dosing apparatus for charging the receptacle with the bulk material to an extent less than the predetermined weight an an additional dosing apparatus for complementing each receptacle with the bulk material to an extent equal to the deviation between the desired weight and the actual weight resulting from the charging by the main dosing apparatus. The additional dosing apparatus has a cellular dispensing wheel having a plurality of cells of predetermined volume. There is further provided a movably supported shroud member having a shroud face extending along a circumferential portion of the wheel and separating an inlet chamber from an outlet chamber. The position of the shroud member is adjustable for determining a minimum clearance between the shroud face and the periphery of the wheel. A spring urges the shroud member towards the wheel for allowing a resilient yielding movement of the shroud member away from the wheel. A stepping motor is coupled to the wheel for rotating the same to discharge the bulk material through the outlet chamber. A scale determines the actual weight of the receptacle. Further, a motor-actuating arrangement is coupled to the scale and the stepping motor for rotating the wheel through as many cell divisions as necessary to fill the receptacle with a quantity of the bulk material corresponding in weight to the deviation.

German Auslegeschrift (Published Accepted Patent Application) No. 2,600,262 discloses a dosing apparatus having a cellular dispensing wheel. It is noted, however, that a use of such a structure is not feasible, because the risk of jamming of the bulk material such as sugar, where lumps are easily formed, is too great. The invention, as outlined above, thus provides, for bulk material, an automatic dosing apparatus which meets the above discussed requirements in a highly satisfactory manner; it is capable, for example, of filling over 100 packages of granulated sugar per minute with superior accuracy and reliability.

By means of the adjustable clearance between the cellular wheel and the shroud face and the resilient yielding properties of the latter, the bulk material is prevented from generating a significant friction between the wheel and the shroud; such a friction would eventually lead to a jamming of the bulk material and thus an immobilization of the stepping motor would occur. The latter is capable of very rapid operation, but should not be loaded excessively, apart from the fact that large frictional forces would result in an impermissible wear of components.

DESCRIPTION OF THE PREFERRED EMBODIMENT

Figure 1:
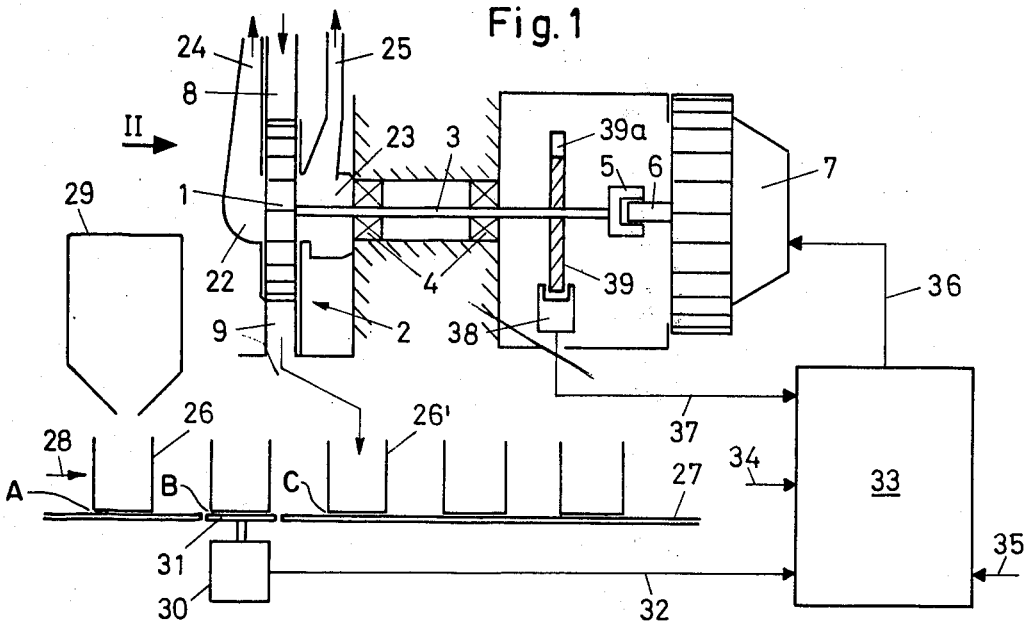
FIG. 1 is a schematic side elevational view of a filling system incorporating a preferred embodiment of the invention.
Figure 2:
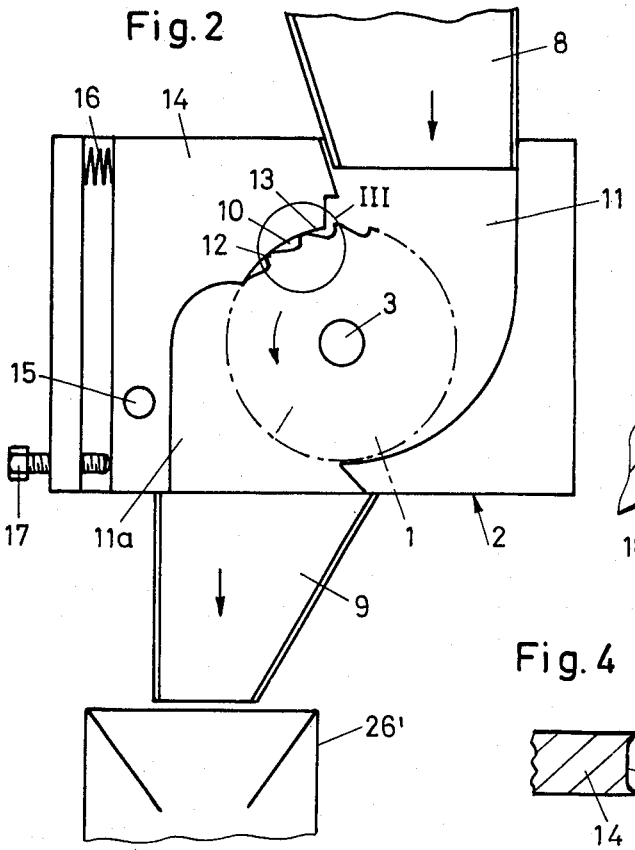
FIG. 2 is a schematic view of one part of the structure shown in FIG. 1, as seen in the direction of the arrow II.

Turning now to FIGS. 1 and 2, the apparatus for a complemental dosing comprises a compartmented (cellular) wheel 1 which is rotatably supported in a housing 2. The wheel 1 is mounted on a shaft 3 which is supported on ball bearings 4 and which is connected by means of a clutch 5 with a shaft 6 of a stepping motor 7 which is of the disc-runner type. At the top the housing 2 cooperates with a supply chute 8, while at its bottom it has a discharge hopper 9. The bulk material, such as granulated sugar is received by the individual cells 10 of the wheel 1 from an inlet chamber 11 at the downstream end of the supply chute 8 and is subsequently dumped from the cells 10 into the discharge hopper 9 from an outlet chamber 11*a* upon rotation of the wheel 1. The cells 10 are formed by spaces between adjoining teeth 12 provided on the periphery of the wheel 1. Also referring to FIG. 3, a shroud member 14 is swingably secured to the housing 2 by a pivot 15 and has an inner concave shrouding wall face 13 which extends along a circumferential length portion of the periphery of the cellular wheel 1 at a clearance c from the tips of the teeth 12. As seen in FIG. 2, the shroud member 14 is urged by a compression spring 16 towards the wheel 1. A set screw 17, if set properly, constitutes an abutment for the shroud member 14 and thus prevents the shroud face 13 from contacting the tips of the teeth 12. In case small material lumps project from the cells 10 as they enter into the zone of the shroud face 13 from the chamber 11, the pivotal shroud 14 resiliently yields, that is, it rocks away from the cells 10 about the pivot 15 against the force of the spring 16. This arrangement thus prevents jamming of the wheel 1.

Figure 3:
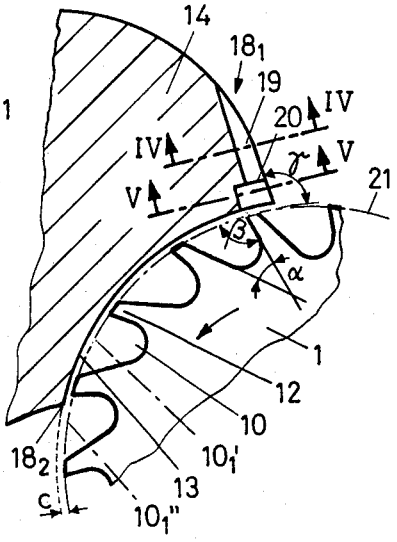
FIG. 3 is an enlarged sectional detailed view of the inset III of FIG. 2.
Figure 4:
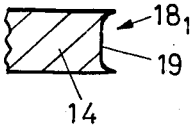
FIG. 4 is a sectional view taken along line IV—IV of FIG. 3.
Figure 5:
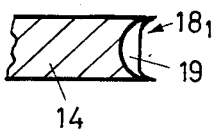
FIG. 5 is a sectional view taken along line V—V of FIG. 3.

Referring now particularly to FIGS. 3, 4 and 5, the shroud member 14 has an inlet edge zone $18_1$ which, by virtue of its particular configuration, ensures that larger lumps entrained by the teeth 12 from the chamber 11 and wedging between the inlet area of the shroud face 13 and the cells 10 are cut up or crushed so that the cells 10 are at all times filled in an accurately uniform manner. Thus, for this purpose, the inlet edge $18_1$ has a hollow wedge 19 which has its maximum depth in the vicinity of the wheel 1 and flattens in a direction away from the wheel 1. As may be observed in FIGS. 3, 4 and 5, the hollow wedge 19 flattens abruptly at 20. It is feasible, however, to provide a more or less gradual transition into the flattened state.

The shape of the cells 10 is of significance to ensure their satisfactory filling and emptying. It is particularly advantageous for a rapid and complete emptying of the cells 10 to provide that the angle $\alpha$ (FIG. 3) which defines the inclination between the leading and trailing walls of each cell 10, is between 20° and 70°, but preferably has a value of approximately 35°; and further, the angle $\beta$ which defines the inclination of the trailing wall of each cell 10 with respect to a tangent drawn to the outer periphery 21 of the wheel 1 at the outer end of the respective trailing wall is an obtuse angle and has a magnitude of preferably between 95° and 120°. Further, the angle $\gamma$ between the inlet edge of the shroud member 14 and the outer periphery 21 of the wheel is expediently slightly greater than 90°. Since, as a rule, the cell walls are not planar, the above angles are construed to be related to a graphically obtainable mean orientation of the cell walls.

As seen in FIG. 1, the housing 2 forms on both sides of the cellular wheel 1 two lateral chambers 22 and 23. These lateral chambers 22 and 23 are, to be sure, sealed with respect to the cells 10 of the wheel 1 by sealing rings (not shown), a penetration of the bulk material, such as powdered sugar, cannot be fully prevented. The chambers 22 and 23 are coupled, by means of respective nipples 24 and 25, to a suction device (not shown) to remove the material which has leaked into the chambers 22 and 23.

Boxes 26 which are, for example, to be filled each with 1000 g granulated sugar, are stepwise advanced in the direction of the arrow 28 on a conveyor track 27 by means of non-illustrated pushers or other advancing devices.

First, the boxes 26 arrive consecutively into a main dosing station A underneath a main doser 29 which may be of any conventional structure and which operates, for example, with an accuracy ±10 g. The main doser 29 is so set that in each instance it empties 980 g weight of material into the box 26. Thus, in any event, the weight of each charge is less than 1000 g. The actual weight of the bulk material delivered by the main doser 29 is determined by a scale 30 having, in a weighing station B, a platform 31 which fits into a discontinuity in the conveyor track 27 and on which the filled box is positioned after it is moved away from under the main doser 29. The scale 30 determines the actual weight of the package of, for example, 985 g and transmits, by means of a conductor 32, an electric signal to an electronic control device 33 for the stepping motor 7. The signal applied to the stepping motor 7 is a measure of the deviation $1000-985=15$ g. Further, at the beginning of each operational cycle, a starting pulse is applied to the control device 33 by means of a conductor 34, in response to which the stepping motor 7 starts to rotate. Power is supplied by a conductor 35 to the device 33 from a current source, not shown.

The control device 33 is connected with the motor 7 by means of a conductor 36 and is also connected with a capacitive sensor 38 by means of a conductor 37. The sensor 38 cooperates in a known manner with a disc 39 which has a plurality of radial slots **39*a* (only one shown in FIG. 1) and which is mounted on the shaft 3. The angular distance between two neighboring slots 39*a* on the disc 39 is identical to the angular distance between two neighboring cells 10 of the cellular wheel 1. The cells 10 are, for example, so dimensioned that each is capable of accommodating 1 g of material. The electric signal applied by the scale 30 to the device 33 may, for example, consist of as many electric pulses as the number of grams to be complementally added to the respective box 26. From the start of each operational cycle of the motor 7, the sensor 38 transmits a pulse to the control device 33 every time a slot on the disc 39 moves past the sensor. When the control device 33 has received as many pulses from the sensor 38 as from the scale 30, the motor 7 is stopped until, by means of the subsequent timing (starting) pulse, it is again started to perform a new cycle of operation. At the end of each operational cycle, a respective cell opening $10_1''$ has, to the greatest part, passed beyond the outlet edge $18_2$ of the shroud face 13, while the subsequent cell opening $10_1'$ is still entirely thereunder. Such a positional relationship between the cell-geometry and the arcuate length of the shroud face 13 increases the operational accuracy of the cellular wheel 1. In FIG. 5 the cell opening $10_1''$ is shown as being approximately 80% externally of the outlet edge $18_2$, that is, the material may flow out practially without hindrance from the cell 10. Thus, in each operational cycle, there are as many cells 10 emptied into a box 26' dwelling in an additional dosing station C, through the hopper 9 as is necessary for complementing the contents of that box to the desired weight of 1000 g. It is to be understood that the box 26' is situated directly underneath the discharge hopper 9; FIG. 1 shows the box further removed from the hopper 9** for clarity of illustration.

In case the main doser 29 performs a filling operation with the maximum positive deviation, that is, it fills 990 g into the underlying box 26, the wheel 1 has to supply complementally in each operational cycle only 10 g, whereas in case of a maximum negative deviation, it has to supply 30 g. The stepping motor 7 can, in each operational cycle of, for example, 0.5 seconds, perform without difficulty a large angular displacement, during the course of which the wheel 1 may advance by 30 cells. Thus, $2\times60=120$ boxes/minute can be filled and dosed supplementally.

The pivotal shroud member 14 is so set with the aid of the set screw 17 that the above-discussed clearance c is maintained at a small value, yet it does not cause any interfering braking of the wheel 1 caused by friction between the bulk material and the shroud face 13. By means of such an advantageous setting of the pivotal shroud member 14, wear of the wheel 1 and the concave shroud face 13 is maintained at a low value. The provision of setting the clearance c and the resilient outward yield of the shroud face 13 are of important significance with regard to an operationally reliable complemental dosing of the packages.

Figure 6:
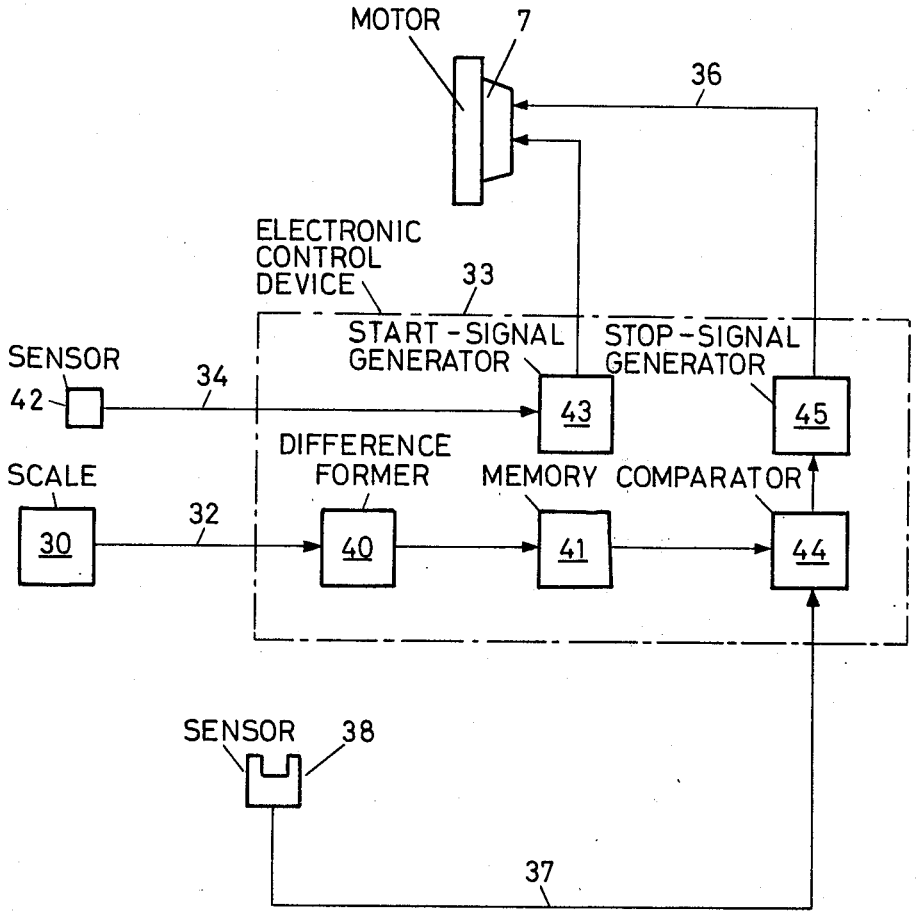
FIG. 6 is a block diagram of a control arrangement incorporated in the preferred embodiment.

Turning now to FIG. 6, there is illustrated, in block diagram form, an example of the individually conventional components of the electronic control device 33.

Thus, a signal representing the weight of the container 26 after its partial filling by the main dosing device 29 is applied by the scale 30, via the conductor 32, to a difference former 40 in which the final, desired weight value is set. A signal representing the deviation between the desired value and the actual value is applied by the difference former 40 to a memory 41.

A sensor 42, responding to the arrival of a just-weighed receptacle 26 into the position 26' underneath the discharge hopper 9, emits a signal which is applied, by means of the conductor 34, to a start-signal generator 43. The latter, in turn, applies a start signal to the motor 7 which thus begins to rotate.

The pulses generated by the sensor 38 upon passage of each slot 39*a* on the disc 39 are applied, by means of the conductor 37, to a comparator 44 which also receives, from the memory 41, the signal representing the deviation. The comparator 44 responds when the two signal counts are the same and emits a signal to a stop-signal generator 45 which applies a stop signal to the stepping motor 7 by means of the conductor 36.

It is to be understood that the above description of the present invention is susceptible to various modifications, changes and adaptations, and the same are intended to be comprehended within the meaning and range of equivalents of the appended claims.

What is claimed is:

1. In a dosing system for filling a receptacle with a predetermined desired weight of flowable bulk material, including a conveyor on which receptacles are forwarded consecutively in a direction of advance, a main dosing apparatus for charging each receptacle, in a main dosing station along the conveyor, with the bulk material to an extent less than the predetermined weight; the improvement comprising an additional dosing apparatus for complementing the receptacle, in an additional dosing station along the conveyor, with the bulk material to an extent equal to the deviation between said desired weight and the actual weight resulting from the charging by said main dosing apparatus; said main dosing station being situated upstream of said additional dosing station as viewed in said direction of advance; said additional dosing apparatus comprising (a) a cellular dispensing wheel having a plurality of cells of predetermined volume;

(b) means defining a material inlet chamber and a material outlet chamber spaced from one another and bounding first and second circumferential portions of said wheel;

(c) a movably supported shroud member having a shroud face extending along a third circumferential portion of said wheel and separating said inlet and outlet chambers from one another;

(d) adjusting means for setting the position of said shroud member for determining a minimum clearance between said shroud face and the periphery of said wheel;

(e) spring means urging said shroud member towards said wheel for allowing a resilient yielding movement of said shroud member away from said wheel;

(f) a stepping motor coupled to said wheel for rotating the same to discharge the bulk material through said outlet chamber;

(g) weighing means for determining said actual weight of the receptacle in a weighing station along said conveyor upstream of said additional dosing station as viewed in said direction of advance; and (h) motor actuating means operatively coupled to said weighing means and said stepping motor for rotating said wheel through as many cell divisions as necessary to fill the receptacle by said additional dosing device in said additional dosing station with a quantity of the bulk material corresponding in weight to said deviation.

2. A dosing system as defined in claim 1, wherein said shroud face has a terminal outlet edge in the zone of said outlet chamber; and further wherein the shroud face is so positioned with respect to the wheel that upon termination of each dosing cycle, one of the cells is situated in a discharging position beyond said terminal outlet edge in said outlet chamber and the cell adjoining said one cell in an upstream direction as viewed in the direction of rotation of said wheel is fully shrouded by said shroud face.

3. A dosing system as defined in claim 1, wherein each cell has a leading wall and a trailing wall as viewed in the direction of rotation of said wheel and wherein the angle defined by the inclination of said walls to one another in each cell is between 20° and 70°.

4. A dosing system as defined in claim 3, wherein said angle is approximately 35°.

5. A dosing system as defined in claim 3, wherein the angle defined by the inclination of said trailing wall to a tangent of the outer periphery of the wheel passing through an outer edge of the trailing wall is between 95° and 120°.

6. A dosing system as defined in claim 1, wherein said shroud member has a pivotal support about which it is swingable; wherein said spring means is a compression spring, and further wherein said adjusting means comprises a set screw; said compression spring urging said shroud member into an abutting relationship with said set screw.

7. A dosing system as defined in claim 1, wherein said shroud face has a terminal inlet edge at said inlet chamber; said inlet edge including means defining a hollow wedge having a decreasing depth along its length; said wedge having its maximum depth at its portion closest to said wheel.

8. A dosing system as defined in claim 1, wherein said motor actuating means comprises (a) first signal generating means for generating a first signal characterizing the magnitude of said deviation;

(b) sensor means operatively connected with said wheel for emitting, during each dosing cycle, a second signal every time a cell of said wheel passes from under said shroud face into said outlet chamber; and (c) second signal generating means connected to said first signal generating means and said sensor means for receiving said first and second signals; said second signal generating means being further connected to said stepping motor for applying a stop-signal to said stepping motor when the sum of said second signals representing a determined total weight of bulk material discharged by said cells during the closing cycle is identical to said first signal representing said deviation.

9. A dosing system as defined in claim 8, wherein said sensor means comprises a disc arranged to rotate in unison with said wheel; markings provided on said disc in a circular distribution; and a seonsor head arranged at said disc for emitting a signal each time a marking moves past said sensor head.

10. A dosing system as defined in claim 9, wherein said markings are slots provided in said disc.

* * * * *